US012546550B2

(12) United States Patent
Cudazzo

(10) Patent No.: US 12,546,550 B2
(45) Date of Patent: Feb. 10, 2026

(54) FIREARM

(71) Applicant: Antonio Cudazzo, Milan (IT)

(72) Inventor: Antonio Cudazzo, Milan (IT)

(73) Assignee: Antonio Cudazzo, Milan (IT)

( * ) Notice: Subject to any disclaimer, the term of this patent is extended or adjusted under 35 U.S.C. 154(b) by 0 days.

(21) Appl. No.: 18/700,210

(22) PCT Filed: Oct. 3, 2022

(86) PCT No.: PCT/EP2022/077429
§ 371 (c)(1),
(2) Date: Apr. 10, 2024

(87) PCT Pub. No.: WO2023/061789
PCT Pub. Date: Apr. 20, 2023

(65) Prior Publication Data

US 2024/0393071 A1 Nov. 28, 2024

(30) Foreign Application Priority Data

Oct. 14, 2021 (IT) ..... 102021000026396

(51) Int. Cl.
*F41A 17/46* (2006.01)
*F41A 3/44* (2006.01)

(52) U.S. Cl.
CPC ..... *F41A 17/46* (2013.01); *F41A 3/44* (2013.01)

(58) Field of Classification Search
CPC ..... F41A 17/46; F41A 17/56; F41A 17/64; F41A 17/74
USPC ..... 42/70.01, 70.04, 70.05, 70.08
See application file for complete search history.

(56) References Cited

U.S. PATENT DOCUMENTS

| | | | | |
|---|---|---|---|---|
| 2017/0184366 | A1 | 6/2017 | Zajk et al. | |
| 2019/0011207 | A1* | 1/2019 | Al-Mutawa | F41A 19/10 |
| 2019/0195587 | A1 | 6/2019 | Thomele et al. | |
| 2019/0390928 | A1 | 12/2019 | Curry | |
| 2021/0278157 | A1 | 9/2021 | Dextraze | |
| 2022/0397359 | A1* | 12/2022 | Velasquez | F41A 19/31 |

OTHER PUBLICATIONS

International Search Report and Written Opinion dated Jan. 20, 2023, from corresponding International Application No. PCT/EP2022/077429.

* cited by examiner

*Primary Examiner* — Bret Hayes
(74) *Attorney, Agent, or Firm* — Troutman Pepper Locke LLP

(57) ABSTRACT

A firearm, particularly a gun operating by recoil exploitation, comprising: a frame; a barrel, a hand grip; a breechblock slidable for the closing of the breech of the barrel; a striker; a longitudinal elastic device for the recovery of the recoil kinetic energy of the breechblock for rearming the striker; a release lever having a coupling position and a release position of the striker; a single action trigger mechanism comprising a trigger and a trigger transmission rod operatively connected to the trigger and to the release lever, and an antagonist lever to the release lever, the mass of the antagonist lever being distributed and arranged to strain the antagonist lever with inertial forces that contrast the release lever for preventing the accidental release of the striker.

14 Claims, 21 Drawing Sheets

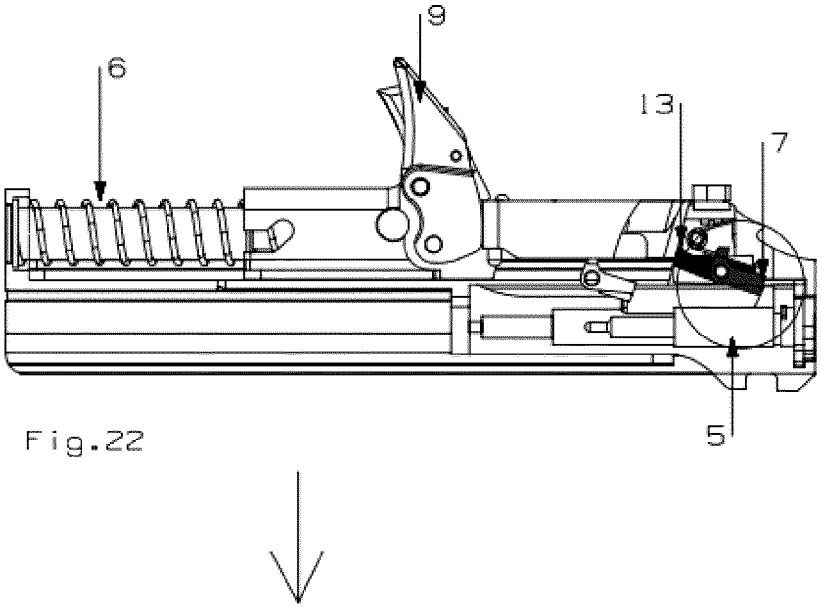
Fig.22
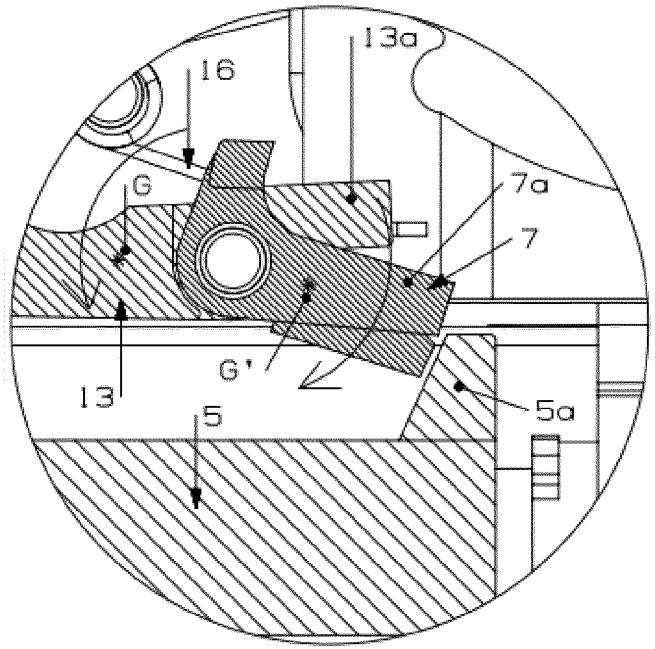

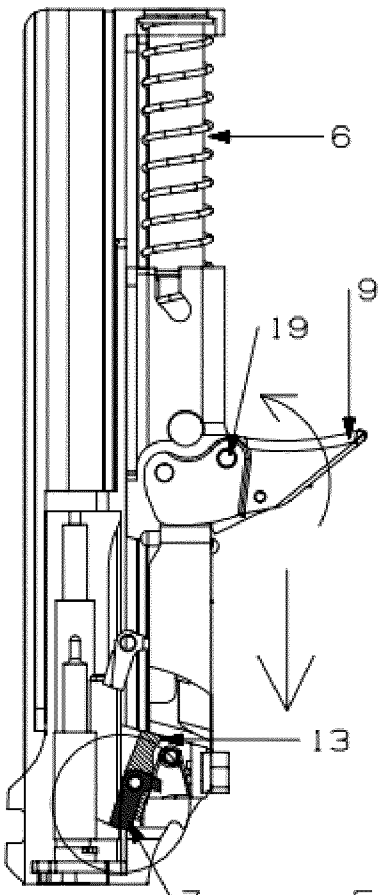
Fig.23
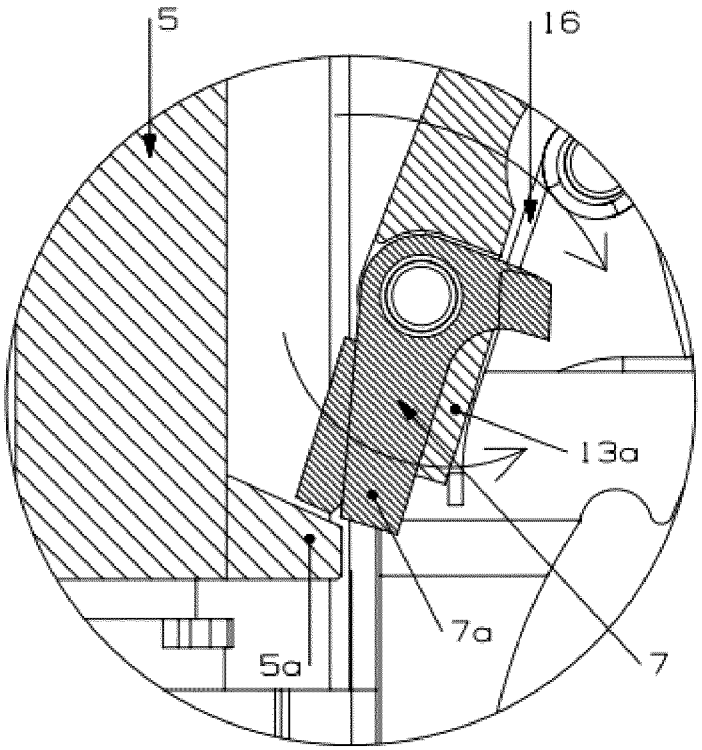

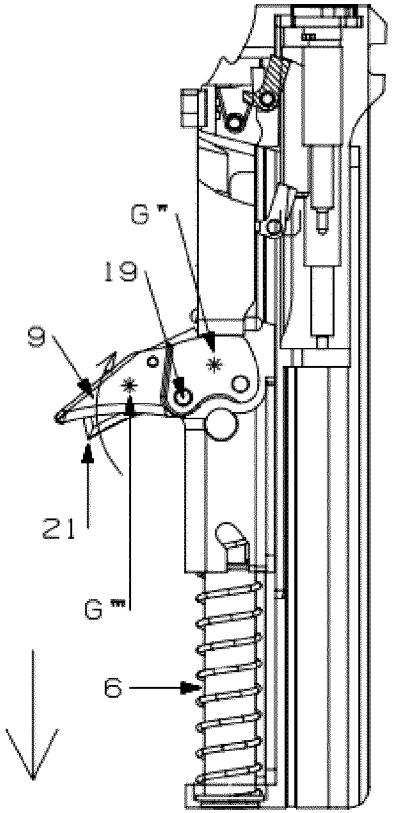
Fig.24
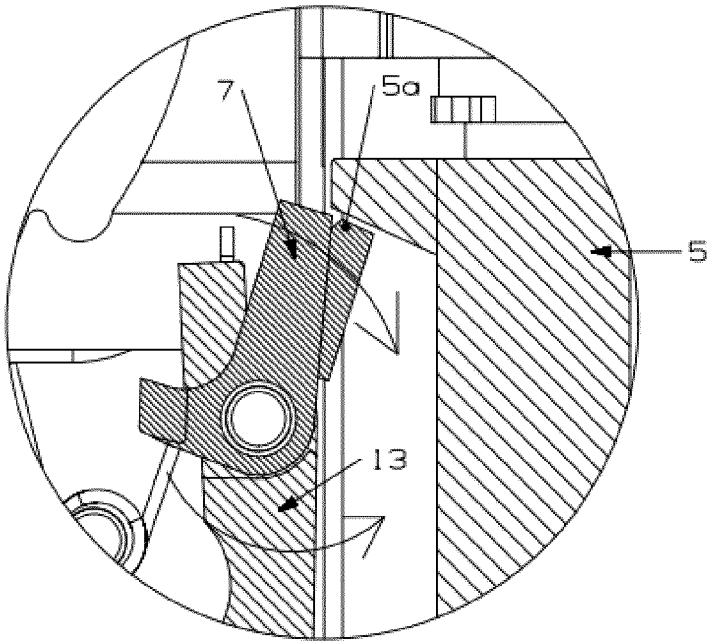

FIREARM

CROSS-REFERENCE TO RELATED APPLICATIONS

The present application is a U.S. National Phase Application under 35 U.S.C. § 371 of International PCT/EP2022/077429 filed Oct. 3, 2022, which claims priority of Italian Patent Application No. 102021000026396 filed Oct. 14, 2021. The entire contents of which are hereby incorporated by reference.

FIELD OF THE INVENTION

The present invention relates to a firearm operating by recoil exploitation.

BACKGROUND

The scope of the invention extends to all hand-held firearms including particularly but not necessarily only pistols, for example also rifles, submachine guns, etc.

Guns of this type have been present on the market for some time that are typically used for personal defense, comprising a breechblock that is slidable along a frame for the closing of the breech of the barrel, a striker slidable in the breechblock, a longitudinal elastic device for the recovery of the recoil kinetic energy of the breechblock for rearming the striker, and a single action trigger mechanism comprising a trigger and a trigger transmission rod operatively connected to the trigger and to a release lever of the striker.

Precisely because of this prevalent use, these guns must be extremely safe, practical, and easy to use, and be compact in order to be stowed easily.

In the design phase, particular attention is thus dedicated to containing the total length and height of the firearm but also to the safe use of the firearm, which involves integrating various mechanisms to prevent accidental and premature shots, and to the ease of use of the firearm that has to enable the striker to be armed by a manual action on the breechblock of an intensity that is exertable without excessive effort by the entire range of possible shooters of both genders.

Many personal defense firearms of the type described above are unable to fully comply with the desired specifications referred to above.

SUMMARY

The technical task of the present invention is therefore to provide a gun operating by recoil exploitation of the type described above that makes it possible to eliminate the cited technical drawbacks of the prior art.

Within the context of this technical task, an object of the invention is to realize a gun operating by recoil exploitation that is safe owing to the fact that it effectively prevents accidental firing. Another aim of the invention is to realize a gun operating by recoil exploitation that is practical to use.

A further aim of the invention is to realize a gun operating by recoil exploitation that is practical to use.

The present invention discloses a firearm, particularly a gun operating by recoil exploitation, comprising: a frame: a barrel which has a longitudinal axis arranged in a median plane of the gun which runs in the front-back direction of the gun and divides said gun into a right part and a left part: a hand grip: a breechblock slidable along the frame parallel to the longitudinal axis of the barrel for the closing of the breech of the barrel: a striker slidable in the breechblock parallel to the longitudinal axis of the barrel; a longitudinal elastic device for the recovery of the recoil kinetic energy of the breechblock for rearming the striker: a release lever having a coupling position and a release position of the striker: a single action trigger mechanism comprising a trigger and a trigger transmission rod operatively connected to the trigger and to the release lever, characterized in that it provides an antagonist lever to said release lever, the mass of said antagonist lever being distributed and arranged to strain said antagonist lever with inertial forces that contrast said release lever for preventing the accidental release of the striker.

The present invention also relates to a firearm, particularly a gun operating by recoil exploitation, comprising: a frame: a barrel that has a longitudinal axis arranged in a median plane of the gun which runs in the front-back direction of the gun and divides said gun into a right part and a left part: the barrel being of the type with a short axial recoil: a hand grip: a breechblock slidable along the frame parallel to the longitudinal axis of the barrel for the closing of the breech of the barrel: a striker slidable in the breechblock parallel to the longitudinal axis of the barrel: a longitudinal elastic device for the recovery of the recoil kinetic energy of the breechblock for rearming the striker: characterized in that there is a closing block supported by said frame in a movable manner in said median plane of said gun along a direction that is tilted with respect to the axis of the barrel and is engageable with the breechblock for locking the breechblock in a closing position, said intermediate block having a body which extends longitudinally in a parallel direction to said axis of the barrel and having a rear wall engaged with the barrel, a front wall engageable with the breechblock and a longitudinal recess which opens at said front wall, where said longitudinal elastic device for the recovery of kinetic energy has a longitudinal rear portion housed in said recess and a longitudinal front portion retractable towards the inside of said recess, and is longitudinally interposed between a front stop abutment solidly constrained to said breechblock and a rear stop abutment solidly constrained to said frame.

BRIEF DESCRIPTION OF THE DRAWINGS

Further characteristics and advantages of the invention will become apparent from the description of a preferred, but not exclusive, embodiment of the apparatus of the gun according to the invention, which is illustrated by way of non-limiting example in the attached drawings, of which:

FIG. 22 shows a raised side view of a partial section in the median plane of the gun, of the set of frame, slide-breechblock, and trigger mechanism in the armed position of the striker, with an enlargement highlighted that shows the action of the safety system that prevents accidental firing in the event of a fall of the gun in a horizontal and overturned position:

FIG. 23 shows a raised side view of a partial section in the median plane of the gun, of the frame, breechblock-slide set, and trigger mechanism in the armed position of the striker, with an enlargement highlighted that shows the action of the safety system that prevents accidental firing in the event of a fall of the gun in a vertical position and with the muzzle of the barrel facing upwards; and FIG. 24 shows a raised side view of a partial section in the median plane of the gun, of the frame, breechblock-slide set, and trigger mechanism in the armed position of the striker, with an enlargement highlighted that shows the action of the safety system that prevents accidental firing in the event of a fall of the gun in a horizontal and straight position and with the muzzle of the barrel facing downwards.

DETAILED-DESCRIPTION

Figure 1:
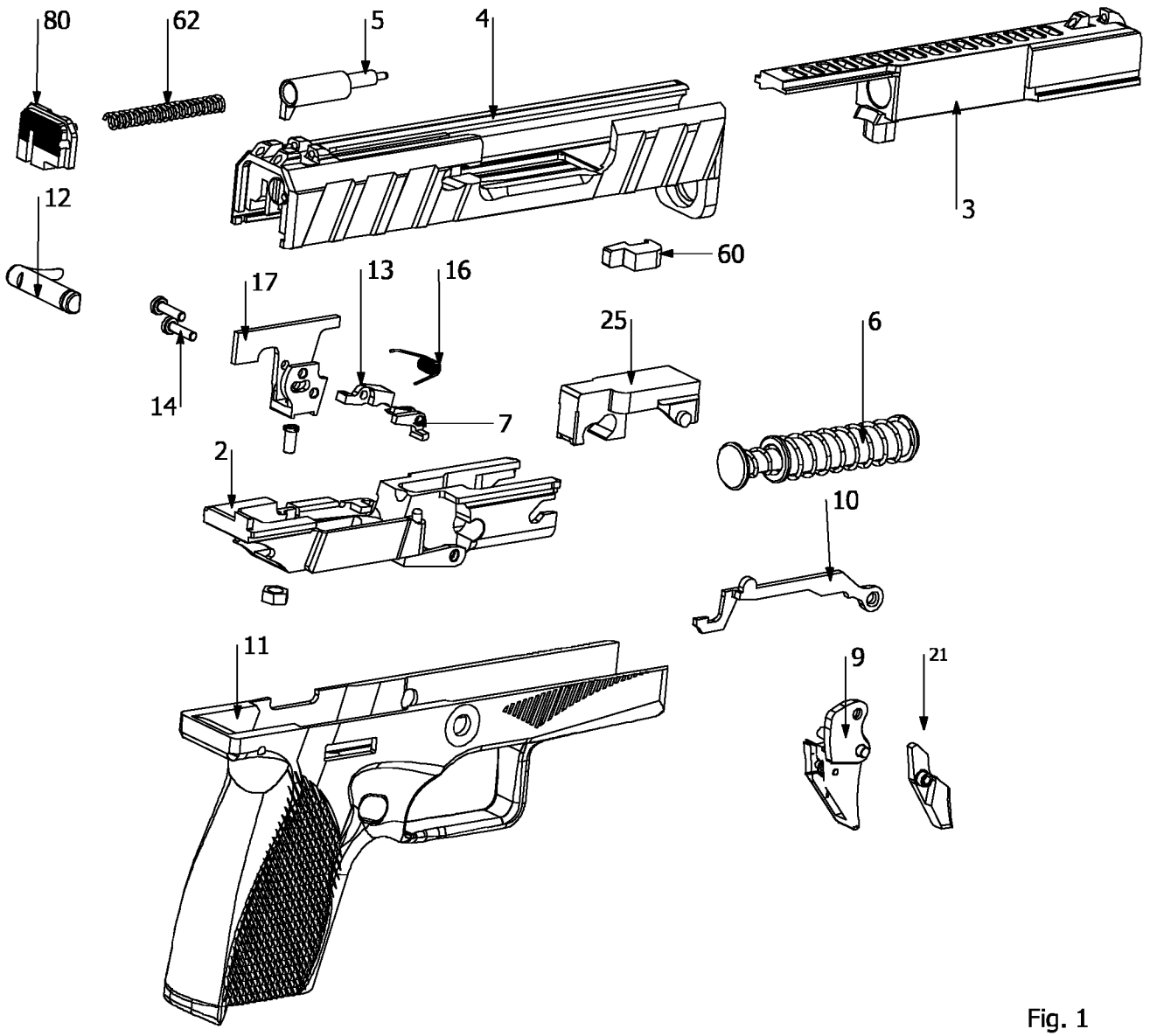
FIG. 1 is an exploded view of the gun.
Figure 2B:
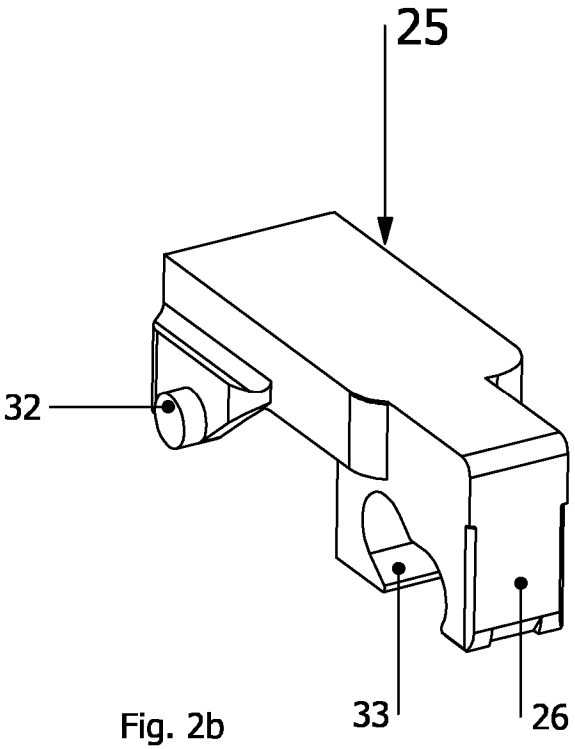
FIGS. 2*a* and 2*b* show an axonometric view of the closing block.
Figure 2A:
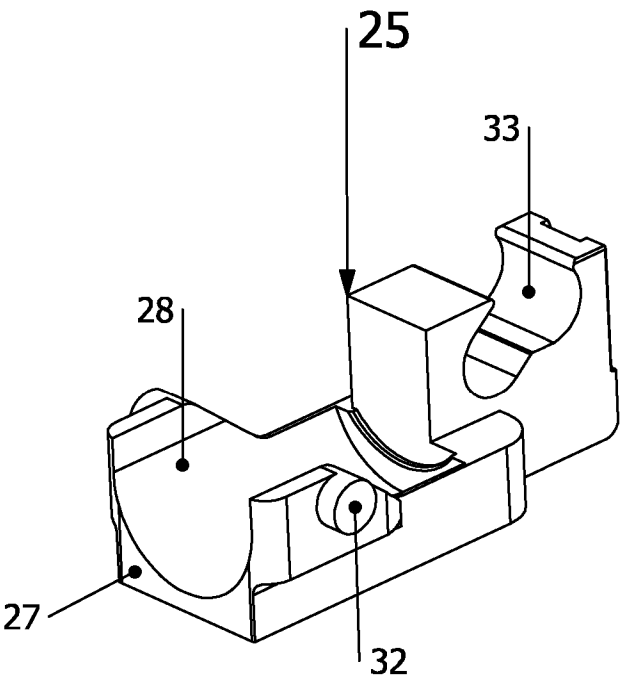
Figure 3B:
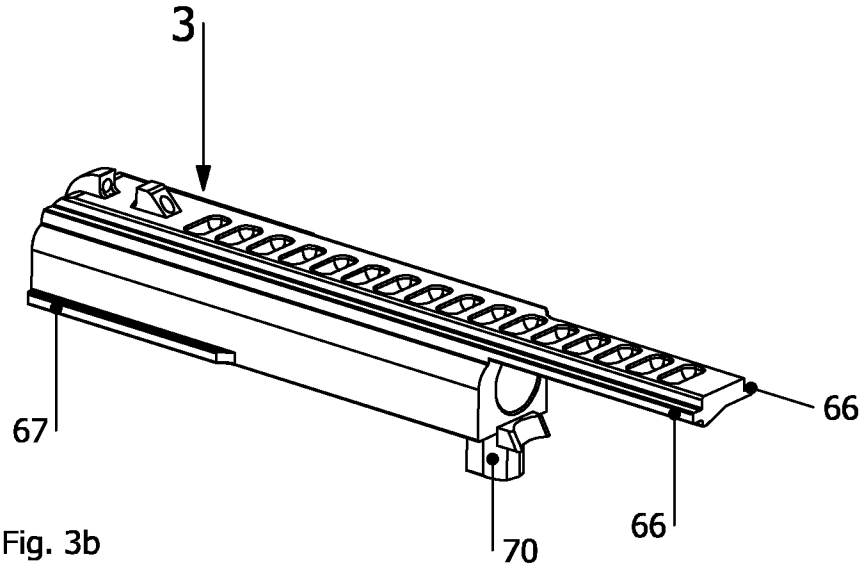
FIGS. 3*a* and 3*b* show an axonometric view of the barrel.
Figure 3A:
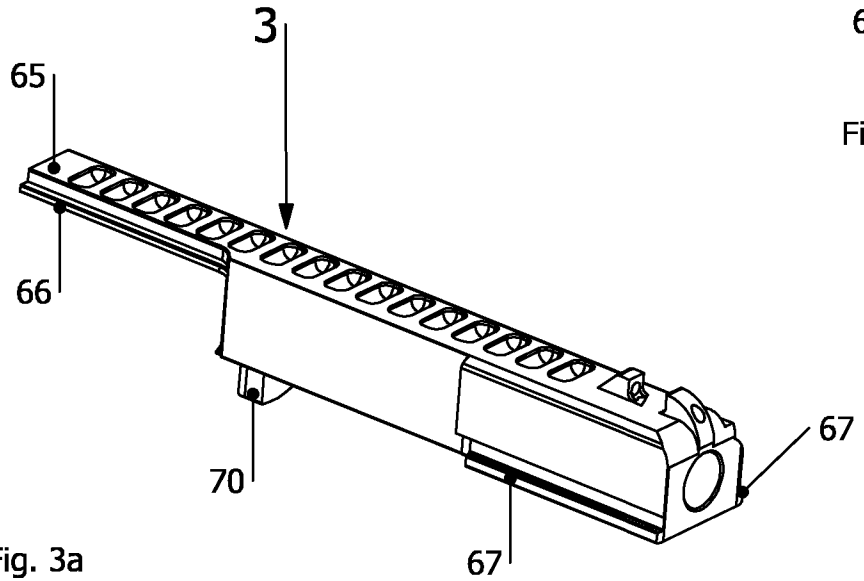
Figure 4B:
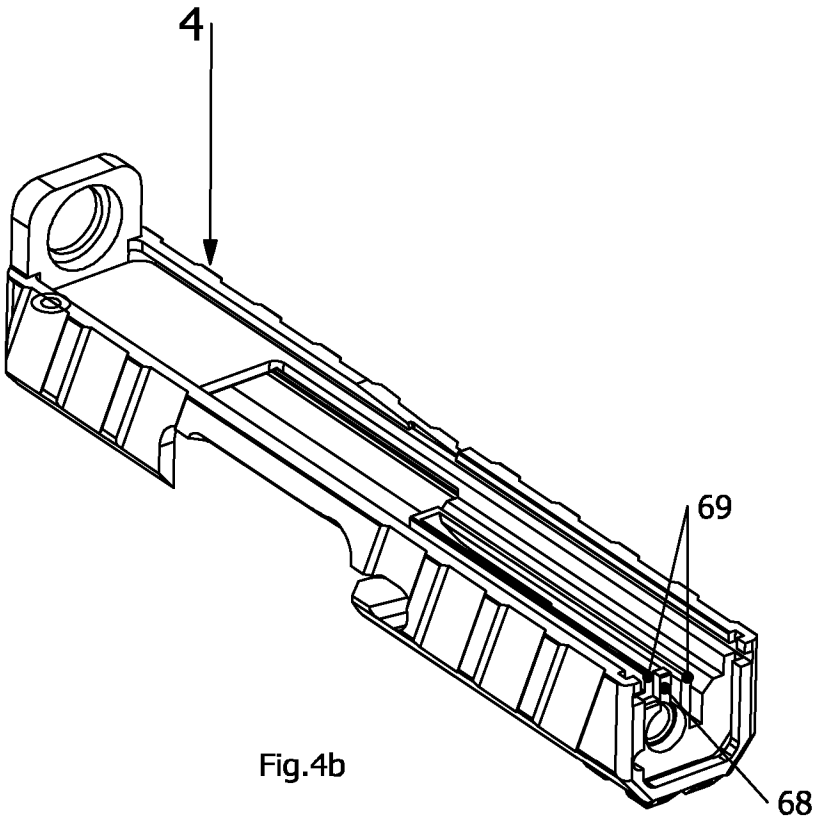
FIGS. 4*a* to 4*d* show an axonometric view of the slide-breechblock.
Figure 4A:
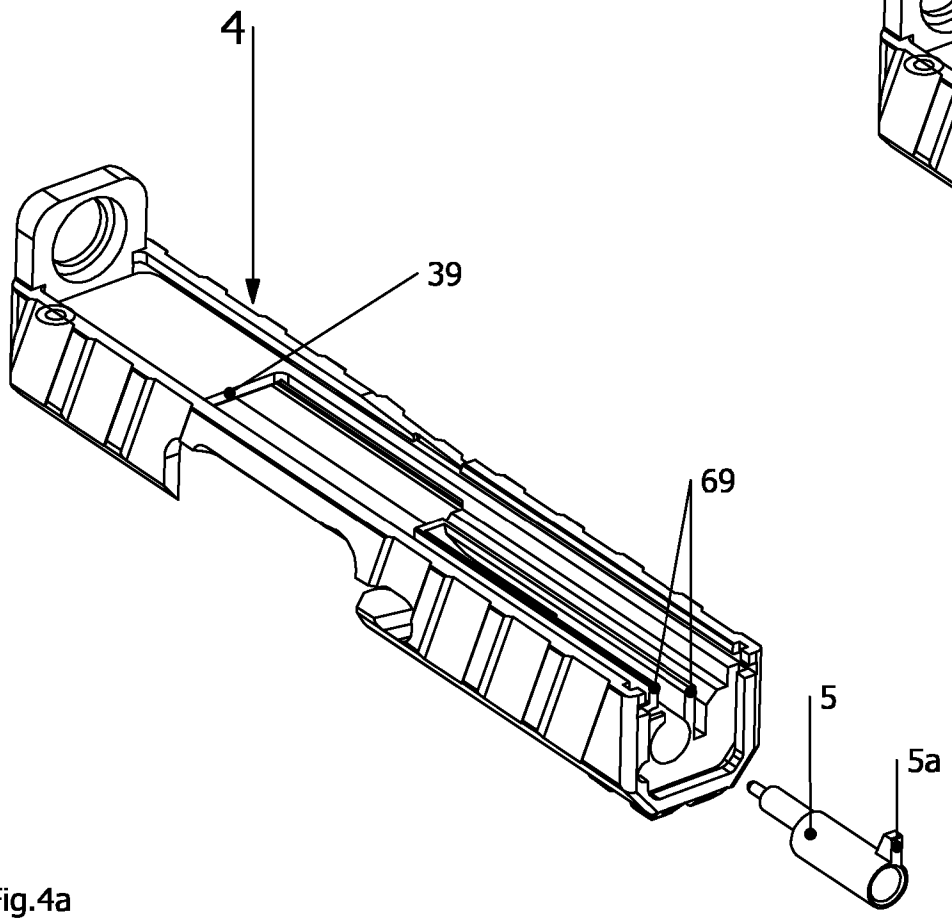
Figure 4D:
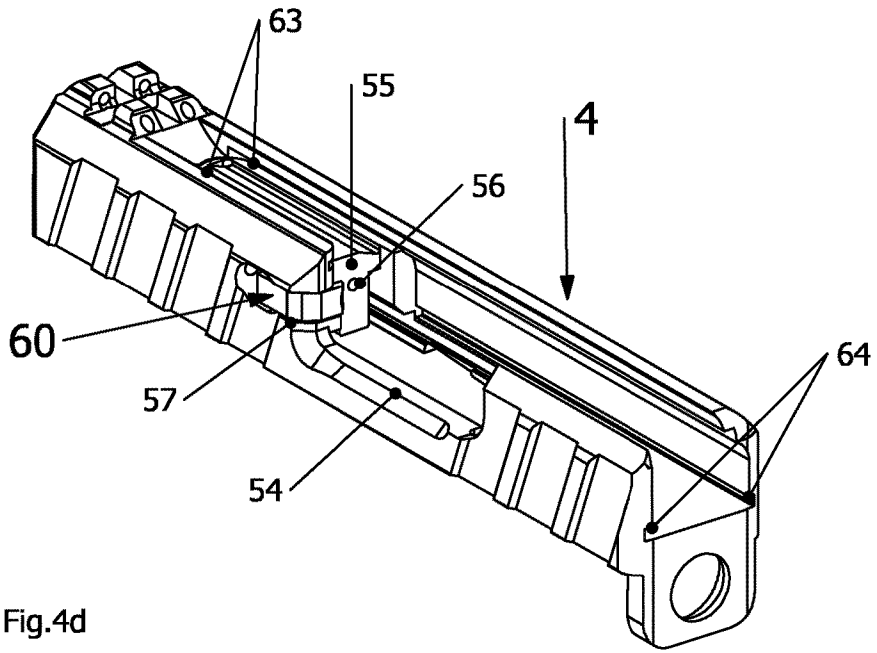
Figure 4C:
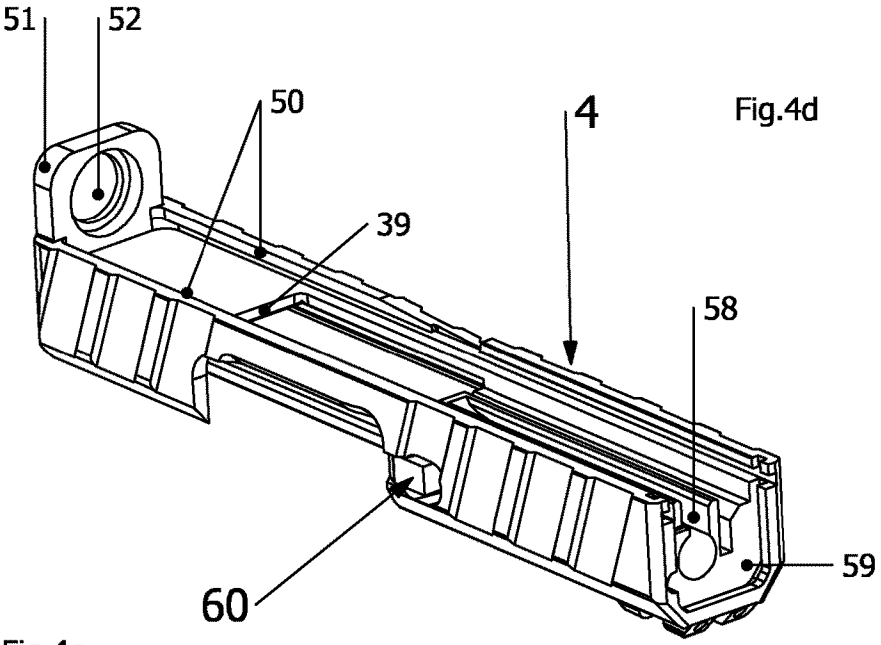
Figure 5:
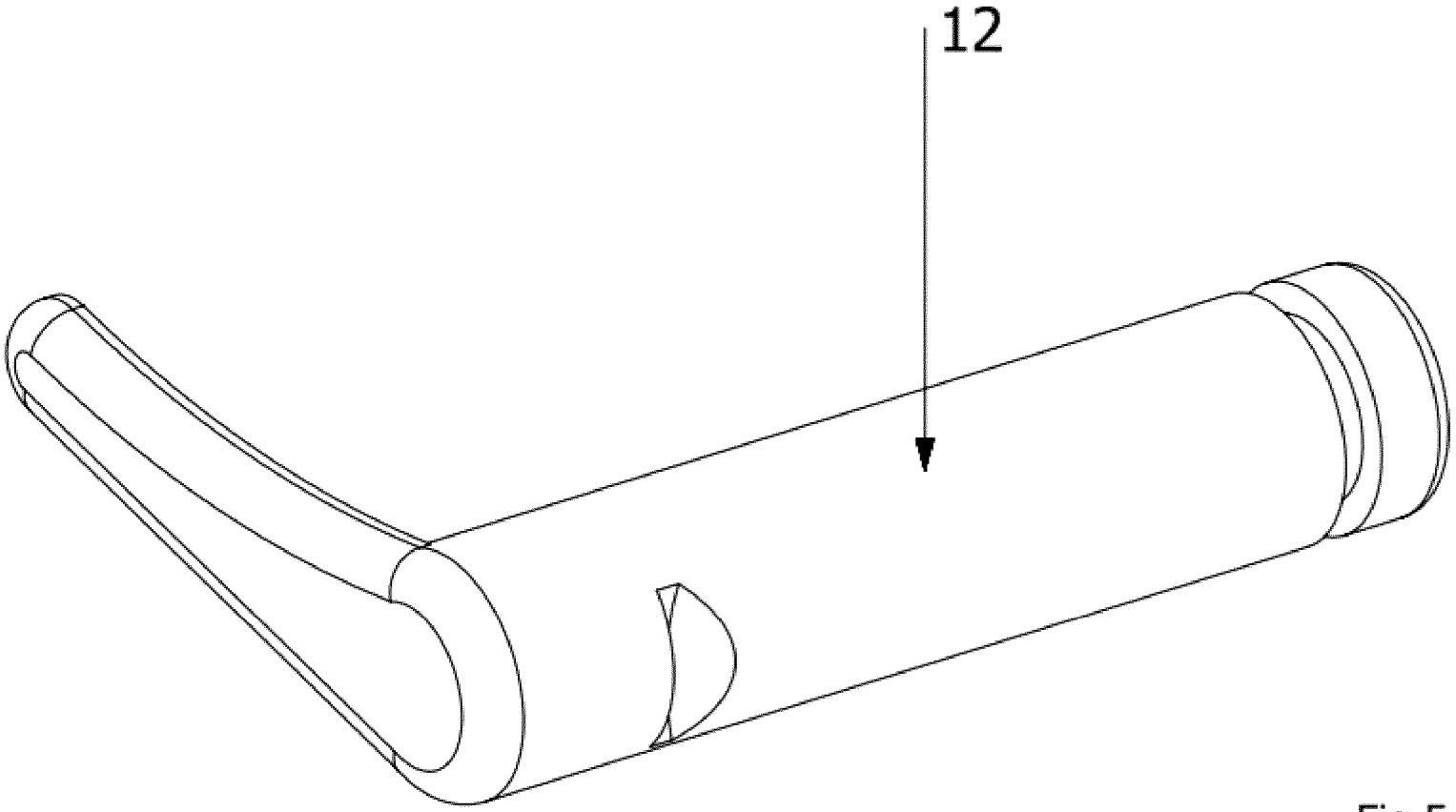
FIG. 5 shows an axonometric view of the dismantling latch for dismantling the firearm.
Figure 6:
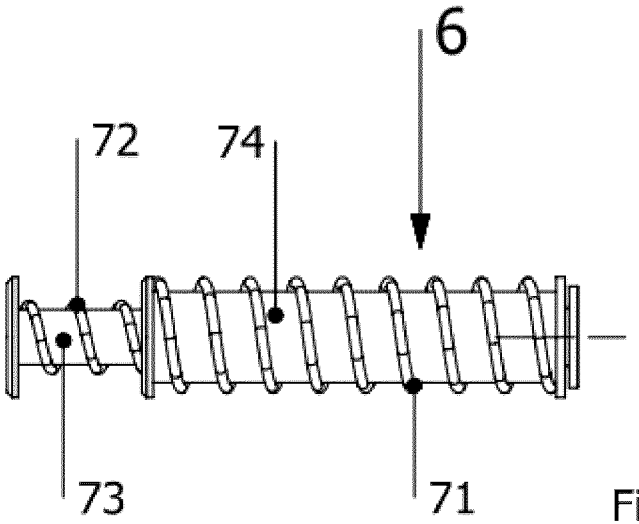
FIG. 6 shows a raised side view of the elastic device for the recovery of the recoil kinetic energy of the slide-breechblock.
Figure 7:
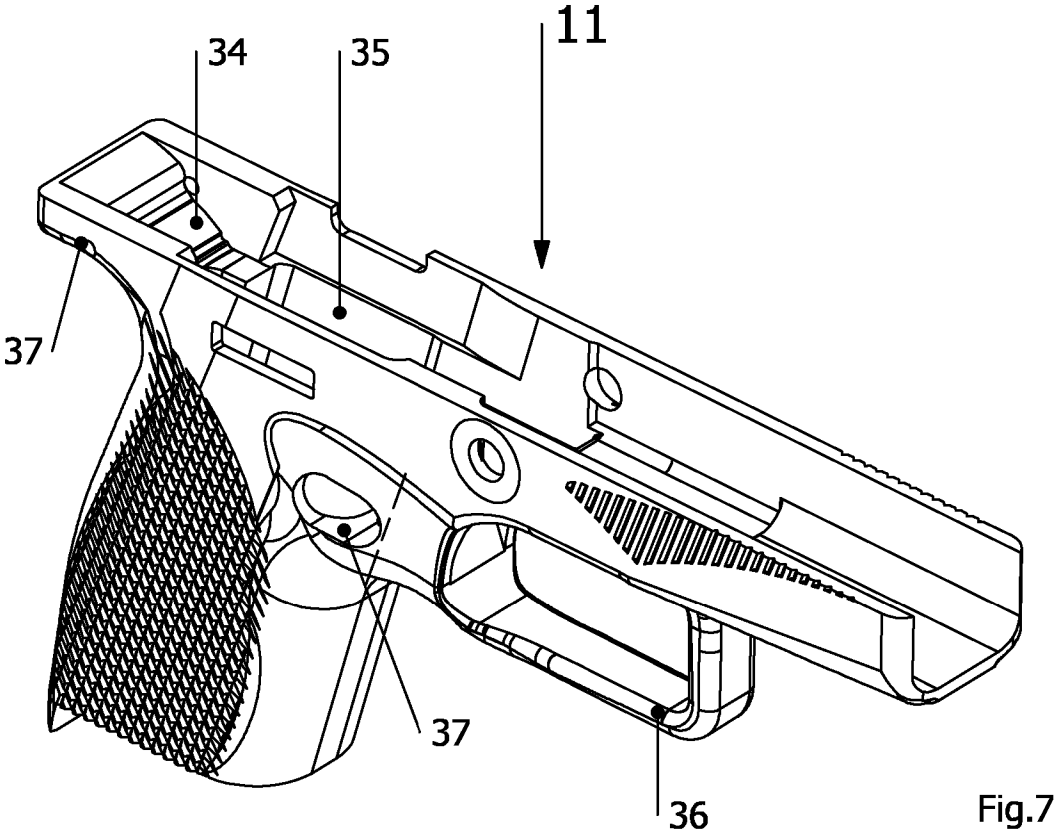
FIG. 7 shows an axonometric view of the hand grip.
Figure 8:
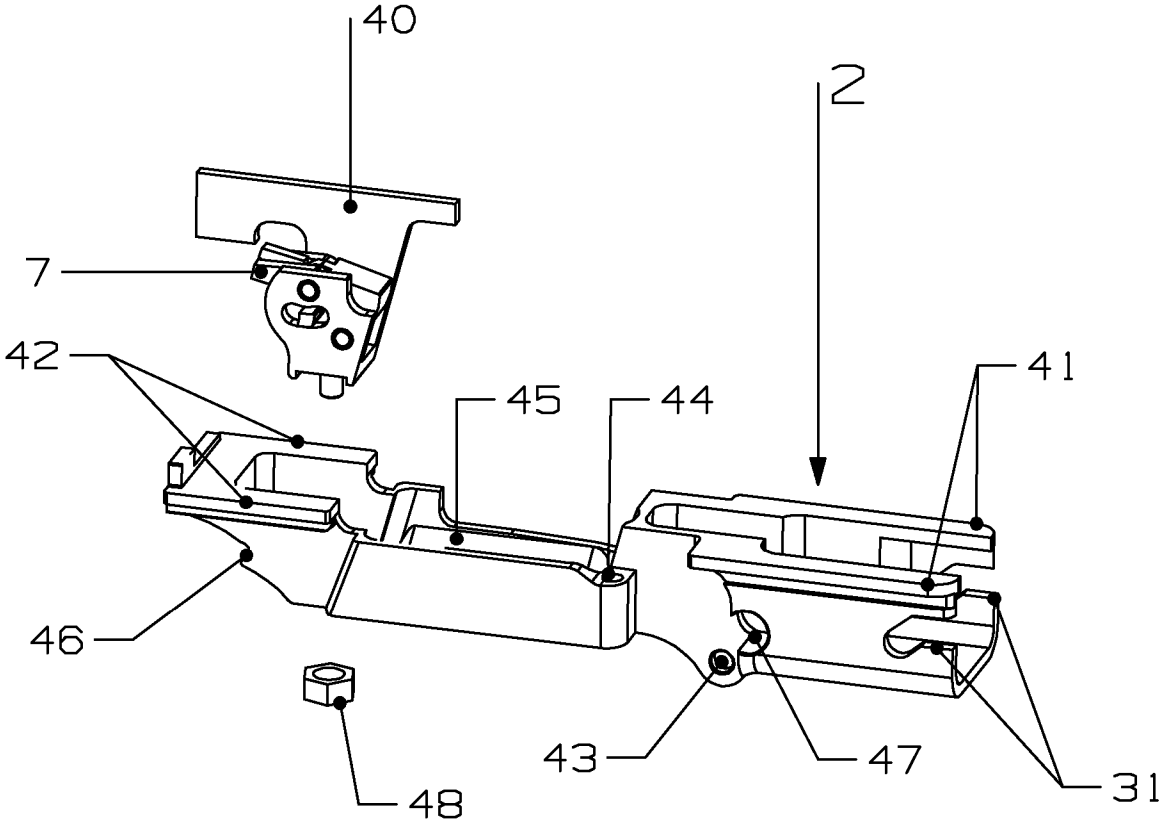
FIG. 8 shows an axonometric view of the frame and the ejector block.
Figure 9:
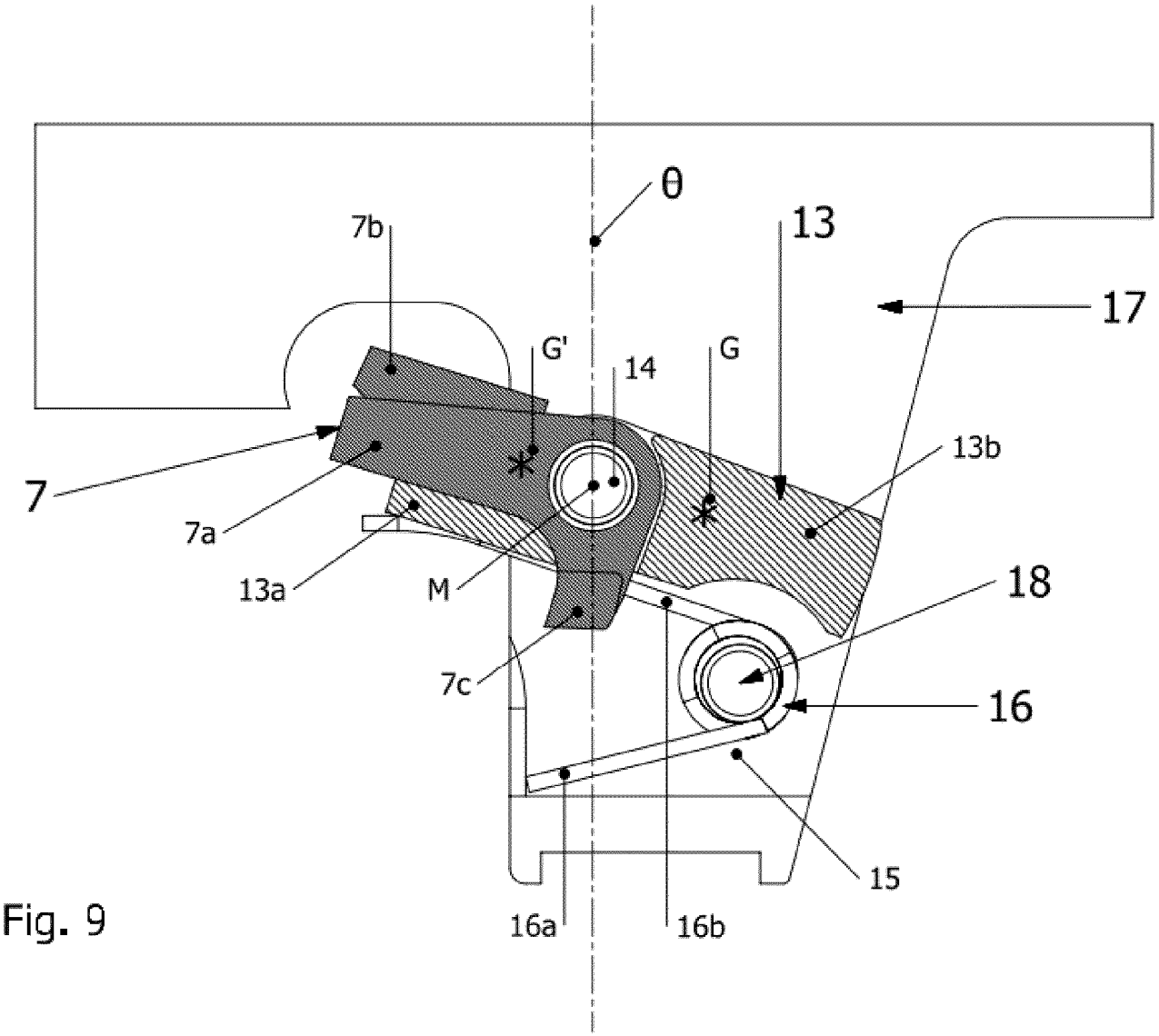
FIG. 9 shows a raised side view of the ejector block on which the release lever of the striker and the antagonist lever are mounted.
Figure 10:
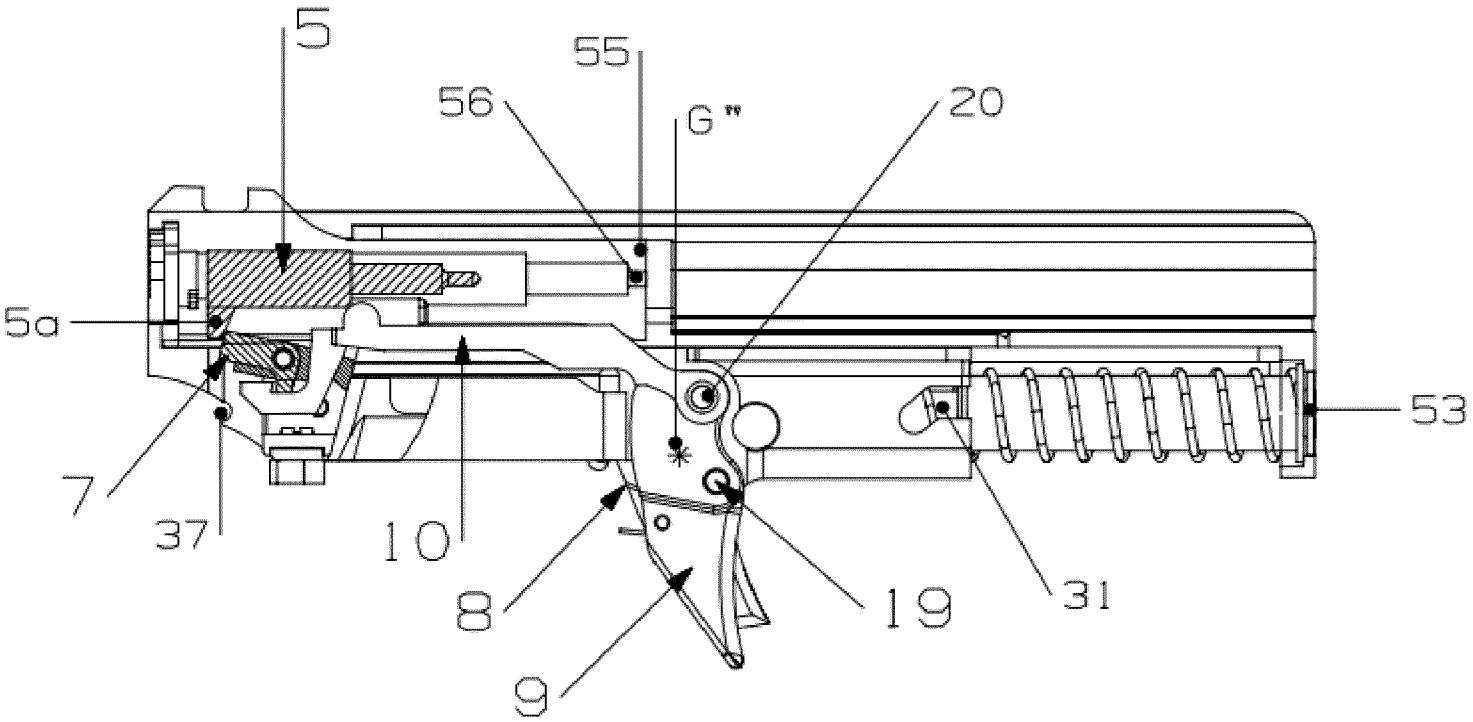
FIGS. 10, 11 and 12 show a partial section raised side view in the median plane of the gun, of the set of frame, slide-breechblock, and trigger mechanism in the firing sequence.
Figure 11:
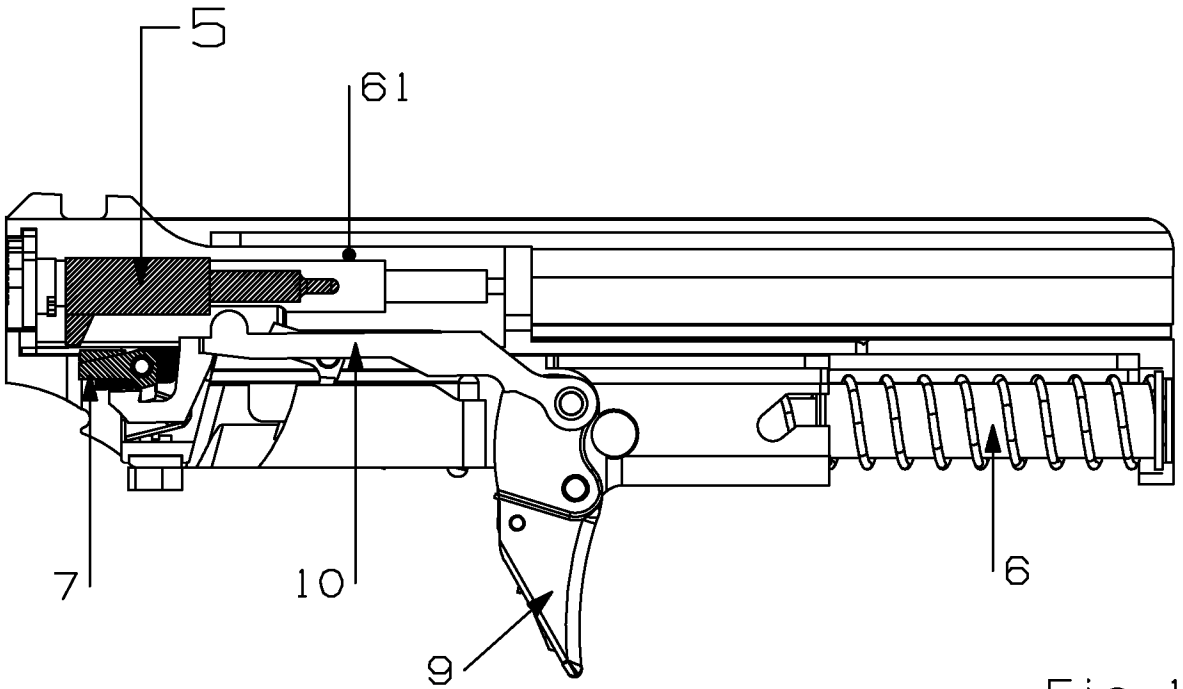
Figure 12:
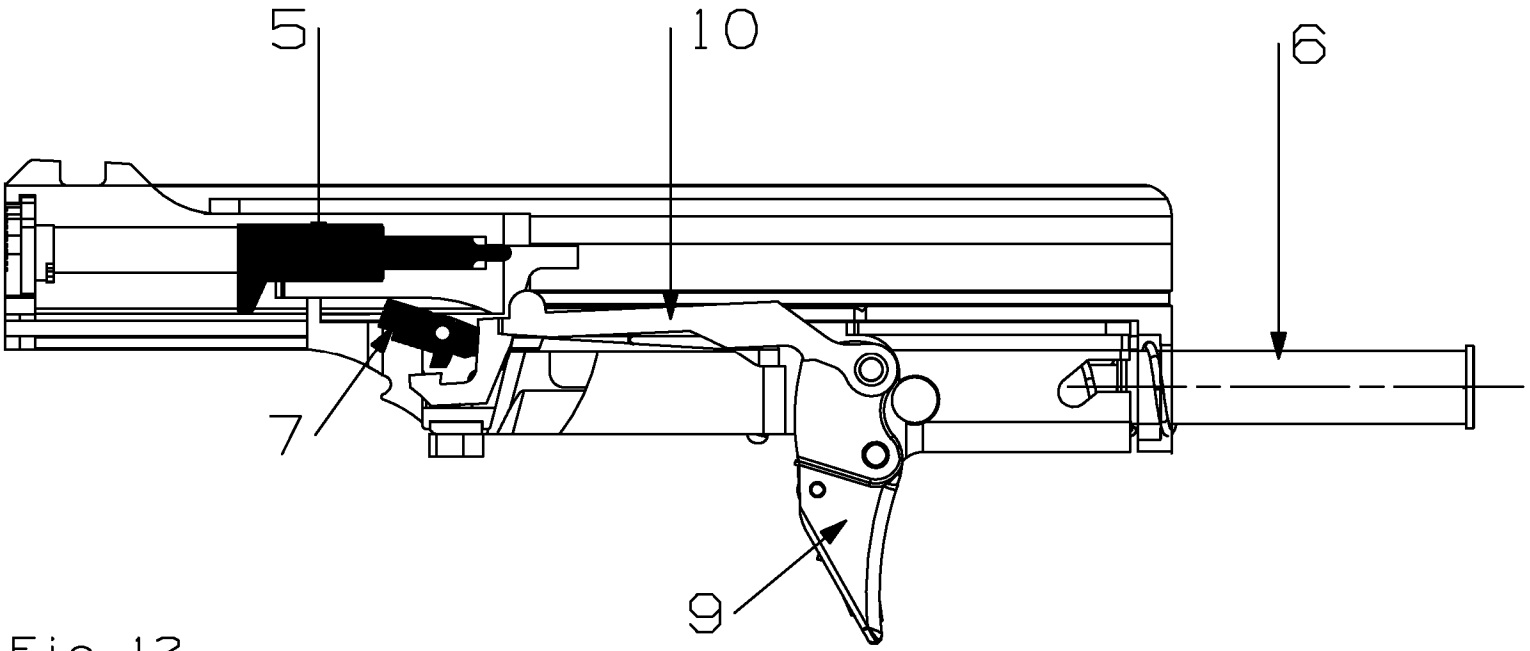
Figure 13:
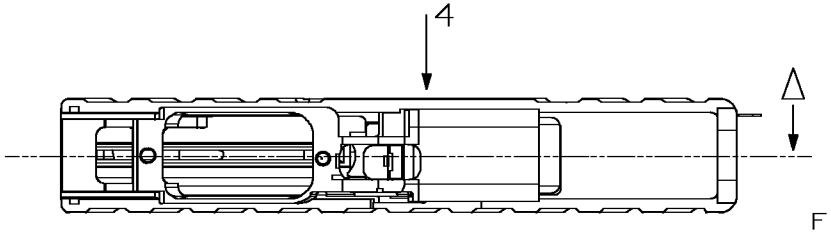
FIG. 13 shows from the bottom the set of the barrel, frame, slide-breechblock and closing block in an advanced and raised engagement position with the breechblock-slide.
Figure 15:
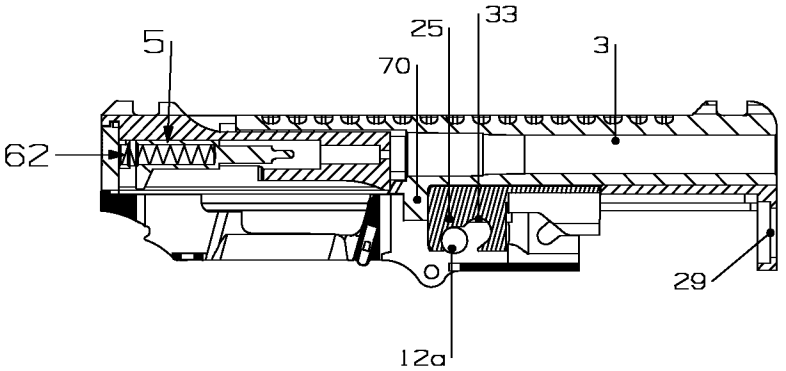
FIG. 15 shows a raised side view of the set of FIG. 13 sectioned along the median plane of the gun.
Figure 14:
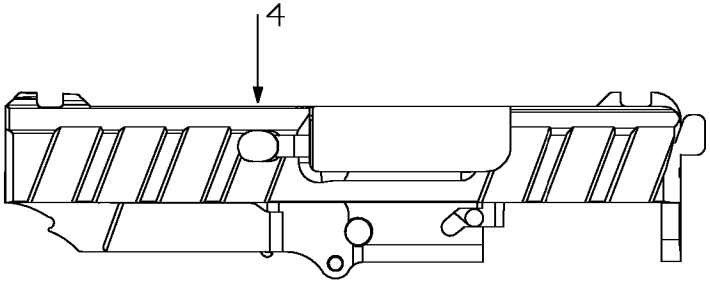
FIG. 14 shows a raised side view of the set of FIG. 13.
Figure 16:
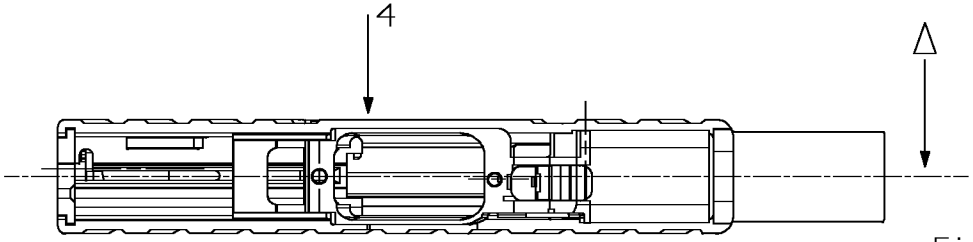
FIG. 16 shows from the bottom the set of the barrel, frame, slide-breechblock and closing block in a retracted and lowered position of disengagement from the slide-breechblock.
Figure 18:
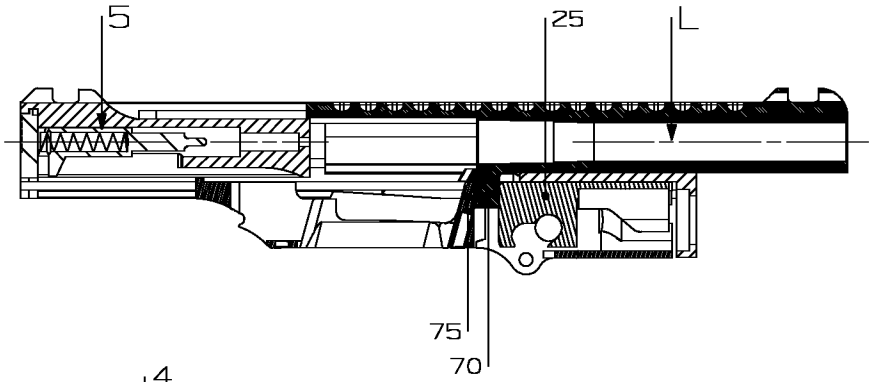
FIG. 18 shows a raised side view of the set of FIG. 16 sectioned along the median plane of the gun.
Figure 17:
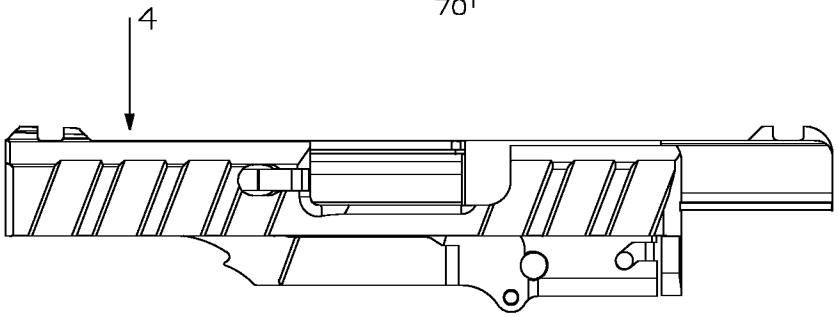
FIG. 17 shows a raised side view of the set of FIG. 16.
Figure 19:
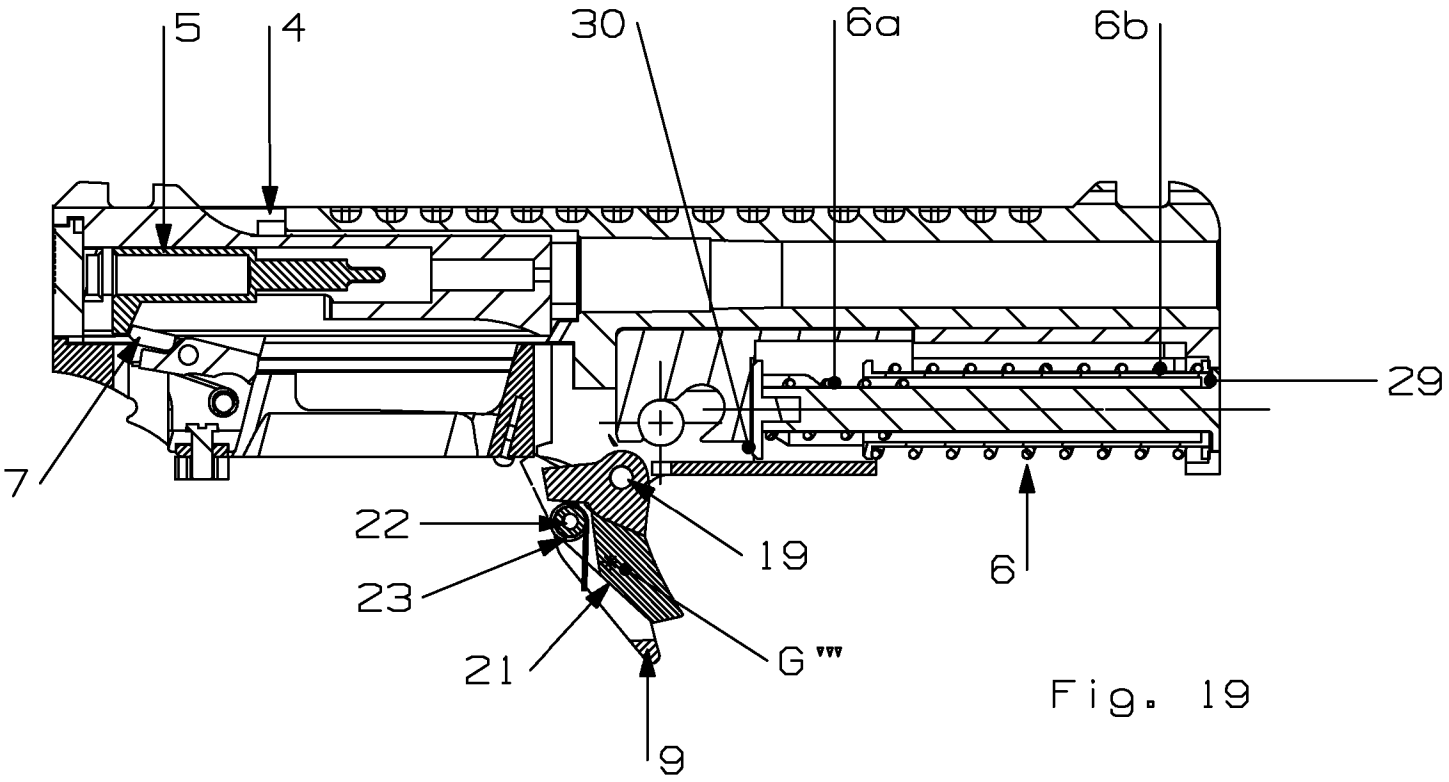
FIG. 19 shows a raised side view of the set, sectioned along the median plane of the gun, formed by a frame, slide-breechblock, device for the recovery of the recoil kinetic energy of the slide-breechblock, trigger and safety lever in the rest position.
Figure 20:
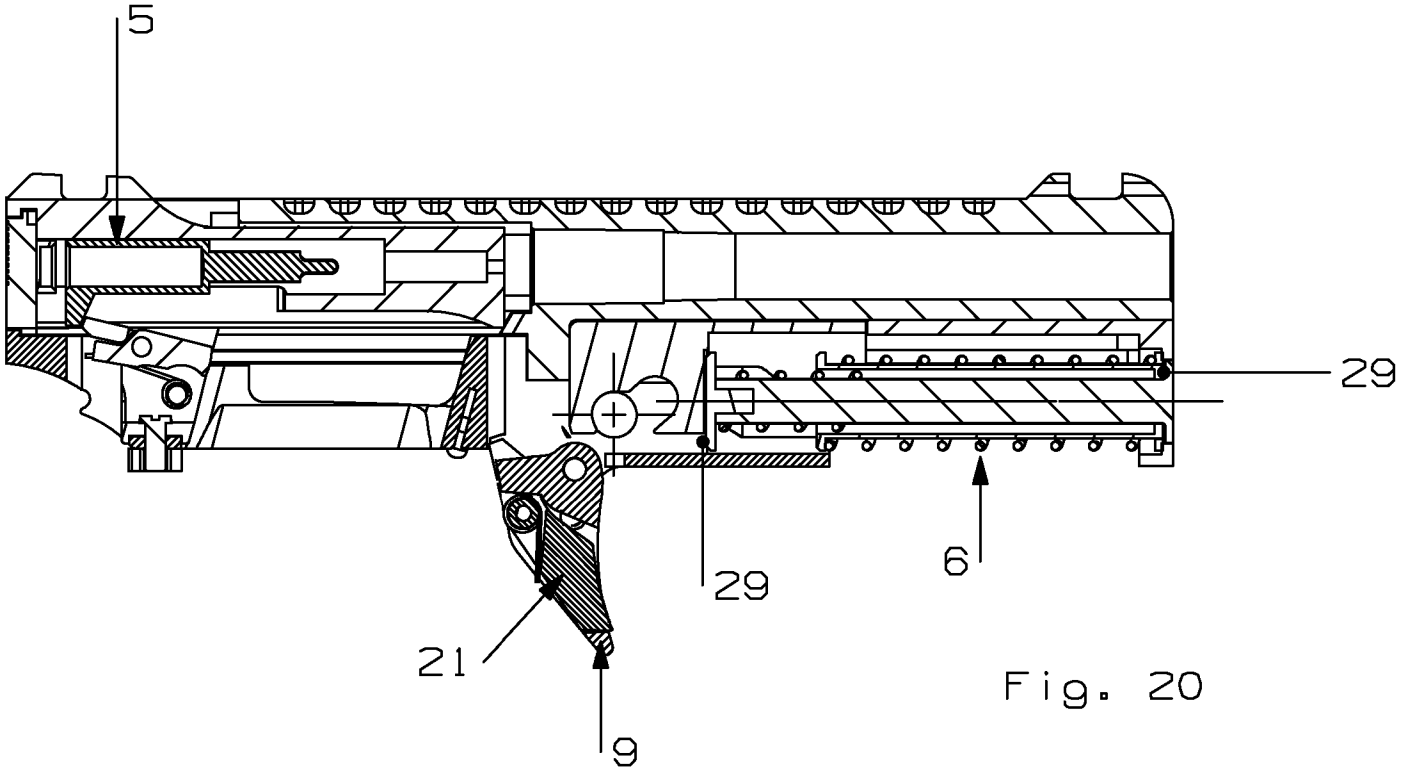
FIG. 20 shows the set of FIG. 19 with the safety lever in a traction position.

In the description, the terms "right", "left", "front", "rear" are used exactly as the user sees them when gripping the firearm.

With reference to the figures mentioned, a gun is shown indicated overall with the reference number 1.

The gun 1 comprises a frame 2, a barrel 3, a hand grip 11, a breechblock-slide 4 (known hereinafter only as breechblock), a striker 5 that can be rearmed through the effect of the recoil of the breechblock 4, a longitudinal elastic device 6 for the recovery of the recoil kinetic energy of the breechblock 4 for rearming the striker 5, a release lever 7 having a coupling position and a release position of the striker 5, and a single action trigger mechanism comprising a trigger 9 and a trigger transmission rod 10 operatively connected to the trigger 9 and to the release lever 7.

The gun 1 further comprises a loader (that is not shown) and a dismantling latch 12 for dismantling the gun 1 provided with a pin 12*a*.

The barrel 3 has a longitudinal axis L arranged in a median plane of the gun 1 which runs in the front-back direction of the gun 1 and divides the gun 1 into a right part and into a left part.

The breechblock 4 is slidable along the frame 2 parallel to the longitudinal axis L of the barrel 3 for the closing of the breech of the barrel 3.

The striker 5 is slidable in the breechblock 4 parallel to the longitudinal axis L of the barrel 3. The hand grip 11 of the gun 1 performs different functions, such as the housing 34 for the frame 2, the seat 35 for the loader, the guard 36 to protect the trigger 9 and the base 36 for fixing the mechanism for retaining the loader.

Inside the hand grip 11, the seat is obtained for the loader which, as usually occurs, has to be inserted into and extracted through the filler present in the lower part of the seat.

At the rear fitting of the guard 36 of the trigger 9, the mechanism for automatically retaining the loader comprises a tooth, pushed by a spring, that is inserted into a special seat obtained on the loader. In order to release said tooth, and thus enable the loader to be extracted, the user must act on a suitable control whilst maintaining the firearm gripped. The position of said control is reversible from the left side of the firearm, where it is normally placed, to the right side to assist left-handed users. The frame 2 is joined to the hand grip 11 at the rear by a through pin 37 of the hand grip and at the front through the dismantling latch 12.

The loader can be extractable, of the two-row type with single exposure of the cartridge and consists of a lifting sole of the cartridges and of a coil spring that acts thereupon, pushing the lifting sole upwards.

The longitudinal elastic device 6 for the recovery of the recoil kinetic energy of the breechblock 4 substantially consists of two coaxial coil springs 71, 72, one inside the other, which are stably constrained on a guide rod 73 and are separate from one another—in order to avoid contacts and interference between the coils thereof—by a tube 74.

In one particularly advantageous aspect of the invention, the gun 1 has an antagonist lever 13 to the release lever 7.

The mass of the antagonist lever 13 is distributed and arranged to strain the antagonist lever 13 with inertial forces that oppose the release lever 7 to prevent the accidental release of the striker 5.

The release lever 7 and the antagonist lever 13 are pivoted on the same rotation pin 14 that is orthogonal to the median plane 0.1 of the gun 1.

The antagonist lever 13 has a mass that is greater than the mass of the release lever 7.

Preferably, moreover, the antagonist lever 13 has a center of mass G that is further from the rotation pin 14 than the center of mass G' of the release lever 7.

The release lever 7 and the antagonist lever 13 have in all cases the respective centers of mass G', G that are arranged opposite a plane 0 containing the geometric axis M of the rotation pin 14 and which is orthogonal to the axis L of the barrel 3.

The release lever 7 and the antagonist lever 13 are connected by an elastic constraint 15.

The elastic constraint 15 is configured and arranged to automatically restore the coupling position of the release lever 7.

The elastic constraint 15 comprises a torsion spring 16 configured and arranged to strain the antagonist lever 13 against the release lever 7.

The release lever 7 comprises a lever arm 7*a* having a coupling tooth 7*b* of the striker 5 and a lever arm 7*c* receiving movement from the transmission rod 10.

The center of mass G' of the release lever 7 is positioned at the lever arm 7*a* having the coupling tooth 7*b* of the striker 5.

The antagonist lever 13 has a lever arm 13*a* where the center of mass G is not arranged and a lever arm 13*b* where the center of mass G is arranged.

The lever arm 13*a* of the antagonist lever 13 where the center of mass G is not arranged is strained by the torsion spring 16 against the lever arm 7*a* of the release lever 7 where the center of mass G' is positioned.

The pin 14 on which the release lever 7 and the antagonist lever 13 oscillate is supported by a block 17 that bears the ejector 40, of the blade type, of the ammunition case.

The block 17 having the ejector 40 is fixed to the frame 2 and is provided with a coupling pin 18 of the torsion spring 16.

In particular, the torsion spring 16 thus has a first arm 16*a* locked on the block 17 having the ejector 40 and a second arm 16*b* that strains the lever arm 13*a* of the antagonist lever 13 where the center of mass G is not arranged.

The second arm 16*b* of the torsion spring 16 strains the lever arm 13*a* of the antagonist lever 13 that in turn transmits to the lever arm 7*a* of the release lever 7 a strain that generates a moment of forces promoting maintaining the coupling position in which the release lever 7 is at the end of its angular stroke.

The safety of the gun 1, as we shall see, is increased by the configuration of the trigger mechanism.

For this purpose, the trigger 9, hinged on the frame 2 by a pin 19 oriented orthogonally to the median plane of the gun 1, has a center of mass G" positioned outside its oscillation pin 19 and favorably on the side of the latter facing the barrel 3.

Also outside the oscillation pin 19 and on the side of the latter facing the barrel 3, the trigger 9 supports a pin 20 on which an end of the transmission lever 10 is hinged the opposite end of which is on the other hand engaged with the gripping arm 7*c* for gripping the movement of the release lever 7.

The trigger 9 houses centrally internally a safety lever 21 pivoted on the trigger 9 by a pin 22 parallel to the pin 19 of the trigger 9.

The safety lever 21 is rotatable with respect to the contrasting trigger 9 and through the action of a torsion spring 23 between a traction position and a rest position.

The safety lever 21 is shaped and arranged to interfere with a stop abutment 24 placed on the frame 2 when it is in the rest position if the trigger 9 is pressed.

The center of mass G'" of the safety lever 21 is positioned outside the oscillation pin 22 and on the side of the latter opposite the barrel 3.

The safety system disclosed above applies to guns operating by recoil exploitation with barrels of different type, for example fixed barrel, short recoil barrel or long recoil barrel.

In the following description we shall limit ourselves to a solution of a gun with a short barrel recoil that has specifications that make the gun particularly compact and convenient to use.

The gun with a short barrel recoil that will be described below has the safety system against accidental firing set out above.

However, applications are not ruled out in which the gun with a short barrel recoil that is particularly compact and convenient to use disclosed below uses another type of safety system.

As said, the gun 1 has a barrel 3 in particular of the type with short recoil along the axis L.

The gun 1 has a closing block 25 supported by the frame 2 in a movable manner in the median plane of the gun 1 along a direction that is tilted with respect to the axis L of the barrel 3.

The closing block 25 is engageable with the breechblock 4 for locking the breechblock 4 in a closed position of the breech of the barrel 3.

The closing block 25 has a body extending longitudinally in a direction parallel to the axis L of the barrel 3.

The body of the closing block 25 has a rear wall 26 engaging with the barrel 3, a front wall 27 engageable with the breechblock 5 and a longitudinal recess 28 that opens at the front wall 27. The breechblock 5 has in particular a window 39 the front wall of which is engageable by the front wall 27 of the closing block 25.

Advantageously, in order to contain the length of the firearm, the longitudinal elastic device 6 for the recovery of the kinetic energy, which extends longitudinally parallel to the axis L of the barrel 3, has a rear longitudinal portion 6*a* housed in the recess 28 and a front longitudinal portion 6*b* that is retractable inside the recess 28.

The longitudinal elastic device 6 for the recovery of the kinetic energy is longitudinally interposed between a front stop abutment 29 solidly constrained to the breechblock 5 and a rear stop abutment 30 that is solidly constrained to the frame 2. Suitable cam guiding means guides the closing block 25 between an advanced and raised engagement position with the breechblock 5 and a retracted and lowered disengagement position of the breechblock 5.

The cam guiding means comprises grooves 31, 33 in which corresponding pins 12*a*, 32 are slidingly housed.

The cam guiding means in particular comprises a pair of grooves 31 present in the front part of the frame 2 into which a pair of pins 32 is inserted that are present in the front in the closing block 25, and a tilted groove 33 present in the rear in the closing block 25, into which a pin is inserted that can be preferably the pin 12*a* of the dismantling latch 12 for dismantling the gun 1. The closing block 25 has as said limited freedom of movement and, to be more precise, can assume two end positions: when the firearm has the breechblock 5 in the closed position—in practice in the firing position—the closing block 25 comes to be in its highest and most advanced position where the front wall 27 of the closing block 25 is inserted into the window 39 against the front wall of the latter and owing to this forms a stable constraint with the breechblock 5: on the other hand, when the breechblock 5 retracts by a few millimeters, it drags with it the closing block 25 that, through the effect of the interaction between the grooves 31, 33 and the pins 12*a*, 32 quoted previously, descends, thus reaching its lowest and most retracted position, and at the end of the descent the front wall 27 of the closing block 25 exiting from the window 39 of the breechblock 4 frees the backward movement.

It must also be noted that the barrel 3 has a lower appendage 70 on which the closing block 25 acts during the firing cycle, causing the barrel 3 to move backwards.

With reference again to the frame 2, it is pointed out that it has a front pair of guides 41 and a rear pair of guides 42 for sliding the breechblock 4, a hole 43 for the pin 19 on which there rotate the trigger 9 and a lever for locking the breechblock 4 in the open position (not shown, commonly known as the hold open position), the seat 44 for the spring (not shown) of the trigger transmission rod 10, the housing 45 for the upper part of the loader, the housing 46 of the through pin 37, the hole 47 for the dismantling latch 12.

The inside of the rear part of the frame 2 contains the breechblock 4 of the ejector 40 fixed by a joint and a nut 48 and bolt 49 fixing.

The breechblock 4 is in turn provided with a pair of full-length guides 50, placed in the lower part thereof, that enable the breechblock 4 to slide on the frame 2, a lower appendage 51 having a hole 52 that permits the transit of a guide rod 53 of the elastic device for the recovery of the recoil kinetic energy, a case ejector window 54, a head 55 with an outlet hole 56 of the striker 5, a seat 57 for the ejector 60, a seat 58 for the striker 5, a seat 59 for a removable plate (not shown) that has the function of retaining in situ the ejector 60, the striker 5 and relative springs.

During the cartridge-feeding step, the hook of the ejector 60 enables the bottom of the cartridge case to rise until it lodges correctly in the head 55 of the breechblock 4; at this point, the hook of the ejector 60 retains the cartridge by acting on the groove present in the case thereof.

The seat for the striker 5 consists of a longitudinal hole 61 on the bottom of which the coil spring 62 is located that impresses the kinetic thrust on the striker 5. A special feature of the breechblock 4 is the presence of two pairs of guides 63, 64 that permit mutual sliding with the barrel 3: a pair of guides 63 is placed in the upper part of the breechblock 4 and couples with sliding guides 66 provided along an upper rear appendage 65 of the barrel 3, the other pair of guides 64 is placed lower and couples with lower front sliding guides 67 of the barrel 3.

In the lower face of the breechblock 4 there is a longitudinal opening 68 that enables the trigger tooth Sa of the striker 5 to slide above the loader in a position that is completely retracted inside two lateral longitudinal guides 69 of the breechblock 4 so as not to interfere with the underlying ammunition contained in the loader during the firing step.

Owing to this feature, a rather long stroke of the striker 5 was obtained in order to ensure a perfectly effective striking with a spring that provides the relatively gentle thrust thereof. It is accordingly possible to use an elastic device 6 for the recovery of the recoil kinetic energy with less stiff recovery springs that facilitate manual loading of the firearm.

The operation is illustrated below of the semiautomatic gun 1 of the type with short barrel recoil with movement of the rectilinear barrel 3 along the axis L thereof.

The operation of the firearm is automatic whereas repetition is semiautomatic (firing of single shots).

The start of the firing cycle starts with the striker 4 closed.

The trigger mechanism is of the single action type, i.e. firing results from the release of the previously armed striker 5 through the effect of the advance (return to the striking mechanism) of the breechblock 4.

Generally, the firearm is used according to the common methods. As will be seen, the firearm intrinsically offers the same guarantees of safety owmg to the automatic mechanisms that prevent accidental firing.

With the firearm in the rest condition (breechblock 4 in closed position, striker 5 not armed, empty cartridge chamber) it is necessary to insert a loader containing the ammunition into the relevant seat.

By gripping the firearm firmly by the hand grip 11, the breechblock 4 then has to be pulled back manually to its most retracted position and then be released freely so that-through the effect of the device 6 for the recovery of the recoil kinetic energy—it returns to the striking mechanism after picking the first cartridge that is present in the loader and inserting the first cartridge into the chamber of the barrel 3.

At this point, the firearm is ready for firing.

The pressure exerted on the central part of the trigger 9 causes advancement of the trigger transmission rod 10, which acts on the release lever 7 of the striker 5, lowering the release lever 7 in the part that bears the trigger tooth 7*b* that engages the trigger tooth 5*a* of the striker 5.

This releases the striker 5—which has been previously armed by the return movement to the striking mechanism of the breechblock 4—which can thus hit with energy the percussion cap of the cartridge that is inside the chamber of the barrel 3.

The firing cycle thus commences. The sudden combustion of the propelling charge—as is well known-generates a considerable increase of pressure inside the cartridge that causes a forward acceleration of the projectile and a force, exerted through the bottom of the case, on the head 55 of the breechblock 4. The latter thus tends to go back and the backward motion thereof drags with it the closing block 25, which, in turn, pushes backwards, by a few millimeters, the barrel 3. It must in fact be noted that the rear part of the closing block 25 is constantly in contact with the lower appendage 70 of the barrel 3: again in this initial step of the firing cycle, the breechblock 4, barrel 3 and closing block 25 set are constrained together.

After this set has moved back by a few millimeters, the effect of the action of the cam guide means, the closing block 25—in addition to being retracted by a few millimeters-lowers. In this manner, this set is released from the breechblock 4, which through inertia can thus continue its backward motion as far as the rear dead center. On the other hand, the barrel 3 stops its backward motion after just a few millimeters, when the lower appendage 70 of the barrel comes to abut against a suitable stop 75 obtained inside the frame 2.

In this step, the two springs 71, 72 are compressed that make up the device 6 for the recovery of the recoil kinetic energy.

The subsequent relaxation of the springs 71, 72 causes the sudden advance of the breechblock 4; during this step, the release lever 7 of the striker 5, pushed upwards by the spring 16, intercepts and engages with its trigger tooth 7*b* the trigger tooth Sa of the striker 5, causing complete arming thereof. Also during the forward return movement to the striking mechanism of the breechblock 4, the head 55 of the breechblock 4 removes—by engaging the bottom—the first cartridge present in the loader that is guided to the cartridge chamber of the barrel 3.

Also during the forward movement of the breechblock 4, the breechblock 4 pushes the barrel 3 forwards, which in turn makes the closing block 25 perform the same movement.

The advancement of the closing block 25 is accompanied-because of the intervention of the cam guide means—by an upward movement of the breechblock. After the breechblock 4 reaches the front dead center, when the breechblock 4 returns completely to the striking mechanism, the firearm is ready for firing because the striker 5 is armed, a cartridge is in the chamber of the barrel 3 and the closing block 25 has restored the stable closing constraint between the barrel 3 and breechblock 4. The trigger mechanism operates in the following manner.

The pressure on the visible part of the trigger 9 causes the advancement of the trigger transmission lever 10, the rear end of which is connected to the release lever 7 of the striker 5.

A torsion spring housed inside the trigger 9 returns the trigger 9 to the rest position.

The firearm also features a disconnecting system for disconnecting the trigger mechanism. At the rear end of the transmission lever 10, a cam is in fact present. During the backward motion of the lower part of the breechblock 4 caused by firing, the lower part of the breechblock 4 comes into contact with said cam, forcing the transmission lever 10 to rotate slightly downwards: this causes the rear end of the transmission lever 10 to disengage from the release lever 7 of the striker 5. The transmission lever 10 will again engage the release lever 7 of the striker 5 only when the breechblock 4 has returned to the completely closed position, the cam can be inserted into a corresponding seat provided for that purpose that enables the rear part of the transmission lever 10 to reascend and thus engage the release lever 7 of the striker 5. It must be noted that the transmission lever 10 is provided with a coil spring, housed in the frame, that by a small pin acts on the lower part of the transmission lever 10 pushing the lower part upwards to maintain the lower part in said position.

The safety lever 21 acts to prevent accidental firing due to involuntary traction on the sides of the trigger 9, the typical case is rubbing of the trigger 9 when the firearm is inserted into the holster. The safety lever 21, during the normal action of firing by the user, is pressed: this enables the trigger 9 to perform complete rotation and thus to start the kinematic chain of the trigger until firing. On the other hand, if pressure on the trigger 9 is not accompanied by simultaneous pressure of the safety lever, the upper end of the safety lever knocks against the stop abutment 24 provided in the frame 2 and prevents the trigger 9 from rotating: the action of improper firing is thus inhibited.

We shall now examine the operation of the automatic safety system designed to prevent accidental release of the striker 5 because of the firearm being subjected to shocks or falls. We have already seen that an automatic safety mechanism incorporated into the trigger 9 prevents involuntary traction when a force is applied to the sides of the trigger 9 and not to the central part thereof. Further, the disconnection system for disconnecting the trigger transmission lever 10 permits firing only when the breechblock 4 is in a completely closed position.

All the parts making up the trigger mechanism perform movements either m an up-down direction or in a backward-forward direction (or in a combination of both); on the other hand, none of them performs movements in a right-left direction.

The consequences of the "flat" drop of the firearm do not therefore have particular importance. On the other hand, the consequences of the firearm falling on its side are exceedingly important. We shall therefore examine four extreme cases without prejudice to the fact that in reality it is probable that one of the infinite combinations thereof will occur.

Figure 21:
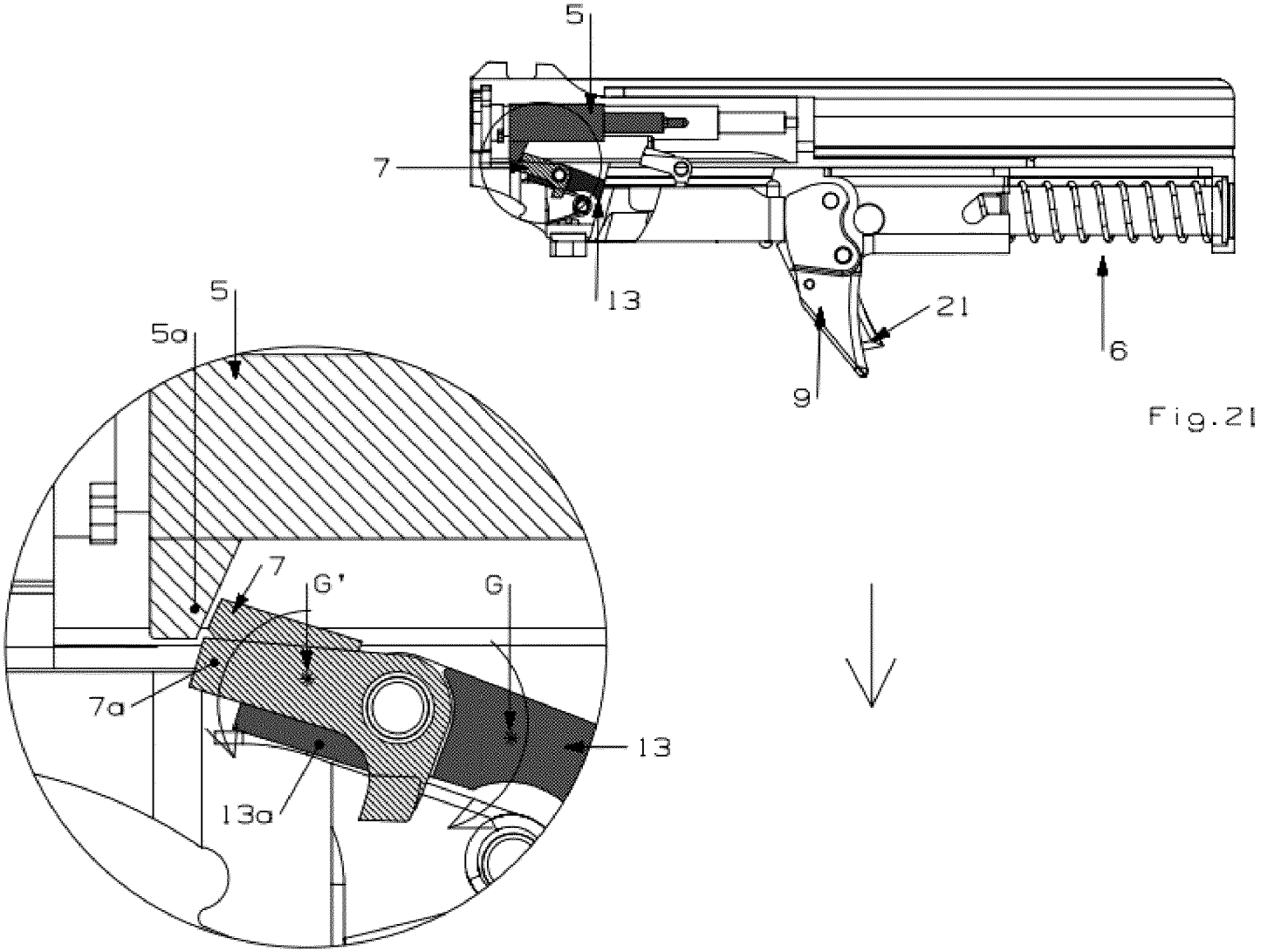
FIG. 21 shows a raised side view of a partial section in the median plane of the gun, of the set of frame, slide-breechblock, and trigger mechanism in the armed position of the striker, with an enlargement highlighted that shows the action of the safety system that prevents accidental firing in the event of a fall of the gun in a horizontal and straight position.

We firstly consider the shock caused by the firearm falling horizontally and straight (FIG. 21). In this case, considering the position of the center of mass G' of the release lever 7, the rear arm 7*a* of the release lever 7 is pushed downwards by inertia and therefore would tend to oscillate in the direction that favors the release of the striker 5 with resulting firing (anticlockwise oscillation direction in FIG. 21). However, this fact cannot occur because, considering the position, the position of the center of mass G of the antagonist lever 13, by inertia the rear arm 13*a* of the antagonist lever is pushed upwards and locks the rear arm 7*a* of the release lever in the coupling position of the striker 5.

We secondly consider the shock caused by the firearm falling horizontally and overturned (FIG. 22). In this case, considering the position of the center of mass G' of the release lever 7, the rear arm 7*a* of the release lever 7 is pushed downwards by inertia and therefore tends to oscillate in the direction that consolidates the coupling position of the striker 5 (clockwise oscillation direction in FIG. 22). In this case, the antagonist lever 13 does not intervene on the release lever 7, instead, the antagonist lever 13 by overcoming the elastic reaction of the torsion spring 16 can at most oscillate in the opposite direction (anticlockwise oscillation direction in FIG. 22), moving its arm 13*a* away from the arm 7*a* of the contrasting lever 7.

Thirdly, we consider the shock caused by falling of the firearm in a vertical position with the muzzle of the barrel 3 facing upwards (FIG. 23). In this case, considering the position of the center of mass G" of the trigger 9, the latter is supported by inertia with the tendency to oscillate in a direction (anticlockwise in FIG. 23) that consolidates maintenance in the rest position of the trigger 9.

Lastly, we consider the shock caused by falling of the firearm in a vertical position with the muzzle of the barrel 3 facing downwards (FIG. 24). In this case, considering the position of the center of mass G" of the trigger 9, the latter would tend to move to the firing position through inertia. Nevertheless, the rotation of the trigger 9 is locked by the safety lever 21 that, owing to the position of the center of mass G" thereof, tends by inertia to oscillate in the opposite direction (anticlockwise in FIG. 24) to the direction required to release the rotation of the trigger 9.

It must be noted that the safe use of the firearm is based exclusively on the distribution of the masses constituting the trigger mechanism: their inertia, in the event of shocks or falls, prevents accidental firing. For the purposes of correct operation of the automatic safety system, the use of systems for accumulating elastic potential energy has no importance.

The gun as conceived herein is susceptible to numerous modifications and variants, all falling within the scope of the inventive concept; furthermore, all the details are replaceable by technically equivalent elements.

In practice, the materials used, as well as the dimensions, can be any according to the needs and the state of the art.

More in general, the scope of the invention can extend also to a manually rearmed firearm not necessarily operating by recoil exploitation, and the firearm, in addition to being a gun, can be a rifle or submachine gun.

The invention claimed is:

1. A firearm comprising:

a frame;

a barrel which has a longitudinal axis arranged in a median plane of the firearm, the median plane dividing said firearm into a right part and a left part;

a hand grip;

a breechblock slidable along the frame parallel to the longitudinal axis of the barrel for closing a breech of the barrel;

a striker slidable in the breechblock parallel to the longitudinal axis of the barrel;

a longitudinal elastic device for recovery of recoil kinetic energy of the breechblock for rearming the striker;

a release lever having a coupling position and a release position of the striker; and a single action trigger mechanism comprising:

a trigger, a trigger transmission rod operatively connected to the trigger and to the release lever, and an antagonist lever, a mass of said antagonist lever being distributed and arranged to oppose rotation of said release lever towards said release position to prevent accidental release of the striker.

2. The firearm according to claim 1, wherein said release lever and said antagonist lever are pivoted about a rotation pin, said rotation pin having a geometric axis orthogonal to said median plane of the firearm.

3. The firearm according to claim 2, wherein said antagonist lever has a center of mass which is more distant from said rotation pin than a center of mass of said release lever.

4. The firearm according to claim 2, wherein said release lever and said antagonist lever have respective centers of mass arranged on opposite sides with respect to a plane containing the geometric axis of said rotation pin and orthogonal to said axis of the barrel.

5. The firearm according to claim 4, further comprising an elastic constraint configured to strain said antagonist lever to oppose the rotation of said release lever towards said release position.

6. The firearm according to claim 5, wherein said elastic constraint is configured and arranged to automatically restore said coupling position of said release lever.

7. The firearm according claim 5, said elastic constraint comprises a torsion spring.

8. The firearm according to claim 7, said release lever comprises a lever arm, wherein the center of mass of the release lever, the lever arm of the release lever, and a coupling tooth of the striker are provided on the same side of the plane containing the geometric axis of said rotation pin, and said antagonist lever has a lever arm, wherein the lever arm of the antagonist lever and the center of mass of the antagonist lever are provided on opposite sides of the plane containing the geometric axis of said rotation pin, said lever arm of said antagonist lever being strained by said torsion spring against said lever arm of said release lever.

9. The firearm according to claim 1, wherein said antagonist lever has a greater mass than that of said release lever.

10. The firearm according to claim 1, said trigger has a pin oriented orthogonally to said median plane of the firearm, and in that a center of mass of the trigger is positioned outside the pin of the trigger on the side of the pin facing towards the barrel.

11. The firearm according to claim 10, wherein said trigger centrally houses a safety lever inside itself having a position for locking a rotation of the trigger, wherein the safety lever has a pin parallel to the pin of the trigger, and the center of mass of the safety lever is positioned outside the pin of the safety lever on the side of the pin of the safety lever opposite the barrel.

12. The firearm according to claim 1, wherein said barrel is of a short recoil type along said longitudinal axis of the barrel, and wherein a closing block is provided, the closing block supported by said frame and moveable in said plane of the firearm along an inclined direction with respect to the longitudinal axis of the barrel and engageable with the breechblock for locking the breechblock in the closing position, said closing block having a body which extends longitudinally in a parallel direction to said longitudinal axis of the barrel and having a rear wall engaged with a downward protrusion integral with the barrel, a front wall engageable with the breechblock and a longitudinal recess which opens at said front wall, where said longitudinal elastic device for the recovery of kinetic energy has a rear longitudinal portion housed in said recess and a front longitudinal portion retractable towards the inside of said recess, and is longitudinally interposed between a front stop abutment constrained to said breechblock and a rear stop abutment constrained to said frame.

13. The firearm according to claim 12, further comprising a cam guide for guiding said closing block between an advanced and raised engagement position with the breechblock and a retracted and lowered disengagement position of the breechblock.

14. The firearm according to claim 1, further comprising an ammunition loader, wherein said striker has a trigger tooth slidable above the loader in a completely retracted position inside two lateral longitudinal guides of the breechblock.

* * * * *